US005248953A

United States Patent [19]

Hönl

[11] Patent Number: 5,248,953

[45] Date of Patent: Sep. 28, 1993

[54] THERMAL OVERLOAD PROTECTION DEVICE FOR ELECTRONIC COMPONENTS

[75] Inventor: Robert Hönl, Berlin, Fed. Rep. of Germany

[73] Assignee: Krone Aktiengesellschaft, Berlin, Fed. Rep. of Germany

[21] Appl. No.: 843,618

[22] Filed: Feb. 28, 1992

[30] Foreign Application Priority Data

Jun. 5, 1991 [DE] Fed. Rep. of Germany ..... 4118738

[51] Int. Cl.[5] ..... H01H 83/10

[52] U.S. Cl. ..... 337/32; 337/28; 337/31

[58] Field of Search ..... 337/28, 29, 30, 31, 337/32, 33, 34; 361/119, 124, 126

[56] References Cited

U.S. PATENT DOCUMENTS 4,984,125 1/1991 Uwano ..... 337/34

FOREIGN PATENT DOCUMENTS

3921225 C1 7/1990 Fed. Rep. of Germany .

*Primary Examiner*—Harold Broome

*Attorney, Agent, or Firm*—McGlew and Tuttle

[57] ABSTRACT

A thermal overload protection device for electronic components, in particular for the telecommunication and data technology. The overload device has a spring-elastic shorting link 6 and a melt element 13. Tripping of the shorting link 6 performed in dependence of the fusing process of the melt element 13. In order to obtain a SERVO FAIL SAFE behavior, the spring force of the shorting link 6 is arbitrarily high. Devices 15, 17, separate from each other, are provided, according to the invention, for separately tripping and actuating the shorting link 6.

11 Claims, 3 Drawing Sheets

THERMAL OVERLOAD PROTECTION DEVICE FOR ELECTRONIC COMPONENTS

FIELD OF THE INVENTION

The invention relates in general to a thermal overload protection device for electronic components, and in particular to a telecommunication and data technology overload device having a spring-elastic shorting link and a melt element. Tripping of the shorting link being performed in dependence of the fusing process of the melt element.

BACKGROUND OF THE INVENTION

A similar thermal overload protection device of the above mentioned species is known in the art from German patent DE 39 21 225 C1. Therein, the electronic component is a gas-filled, three-pole surge arrester. The central electrode is pressed against the melt element under the action of the spring-elastic shorting link. The shorting link comprises two laterally projecting contact fingers, being held spaced to the outside electrodes of the surge arrester. For an overload existing for a longer period of time, the melt element will fuse, so that the shorting link connects, with its two contact fingers, the two outside electrodes directly with the earthed central electrode, thus the surge arrester being protected against damage.

With the prior art thermal overload protection device for electronic components as a so-called FAIL SAFE protection device, it is possible, in particular for common gas-filled surge arresters, to reduce the risk of overheating. This is achieved by the melt element, which may be a solder pill or another thermally sensitive element and which fuses after a limit temperature at the surface of the surge arrester has been exceeded and yields to the spring-loaded shorting link. It has shown, however, that an arbitrarily high spring force cannot be selected for such a thermal overload protection device, since otherwise, a plastic deformation of the melt element may occur in the operating temperature range and may lead to an undesired shorting of the electrodes of the surge arrester. With the common spring forces, the obtainable contact forces between the shorting link and the electrodes are, however, too small, so that a surge-current resistant shorting cannot be achieved, the rated arrester surge current being regarded as the surge current. In the most unfavorable case, when the FAIL SAFE device is tripped by an a.c. load of the surge arrester, and a surge load is caused, the contact finger of the shorting link may be damaged, thus the FAIL SAFE device being made ineffective, and an overheating of the surge arrester being possibly generated, which may even lead to a fire.

Electronic components may be provided with a thermal overload protection device such as the gas-filled surge arresters in two or three-pole designs. Also semiconductor surge arrester devices can be employed, such as triacs, thyristors, Zener diodes and the like.

SUMMARY AND OBJECTS OF THE INVENTION

The invention is based on the object, to provide a thermal overload protection device of the mentioned species, which is improved over the prior art protection device. In particular the contact force of the shorting link pressing against the electrodes of the electronic component to be protected being sufficient to transfer existing surge currents.

As a solution of this object, the invention provides that devices separated from each other are provided for tripping and for actuating the shorting link, resp. According to the invention, the thermal overload protection device for electronic components, in particular for the telecommunication and data technology, is adapted as a SERVO FAIL SAFE device, tripping of the protection device and shorting of the electrodes being performed by separate devices. The tripping device cooperates with the melt element, which is a thermally sensitive element, such as a solder pill. The tripping device is, however, independent from the actuating device for the shorting link, so that the tripping device is only an auxiliary device for releasing the shorting link, for which a separate actuating device is provided.

In an actual embodiment, the tripping device is composed of a spring-elastic tripping link, which is held spaced to the electronic component by means of the melt element. The actuating device is formed of a locking element, holding the shorting link spaced to the electronic component, and the tripping link acting thereon for releasing the actuating device. The tripping link also being spring-elastic may be a spring of low directional capacity, which is only used for releasing the locking element, which in turn releases a nearly arbitrarily strong spring in the form of the shorting link, which may be designed, in its pressure force, such that the resistance against surge currents is guaranteed.

Further advantageous embodiments of the invention can be found in the following descriptions.

In the following, the invention is described in more detail, based on several embodiments represented in the drawings of thermal overload protection devices for gas-filled two or three-pole surge arresters and a semiconductor protection element as electronic components.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
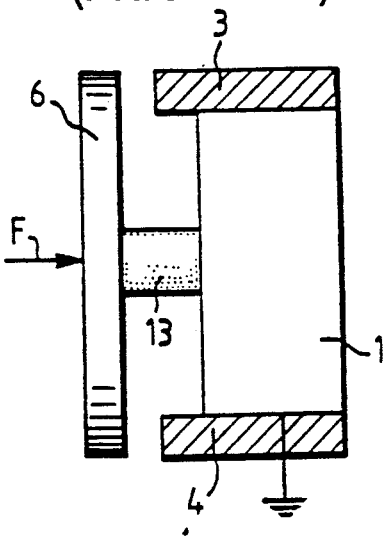
FIG.1 (PRIOR ART)
FIGS. 1 and 2 representation of the operating condition or the tripping condition, resp., of a two-pole surge arrester with a prior art thermal protection device.
Figure 2:
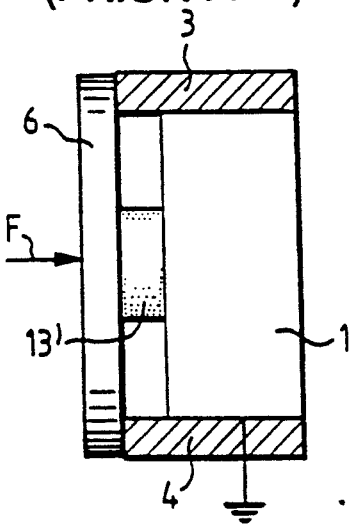
FIG.2 (PRIOR ART)

Referring now to FIGS. 1 and 2 of the prior art, there is a two-pole surge arrester 1 having two outside electrodes 3, 4 and a melt element 13, against which, in well-known manner, a spring link 6 is pressed under the action of the spring force F. When a thermal overload occurs for a long period of time, the melt element 13 will fuse, and obtains the shape shown in FIG. 2. Then, the contact fingers of the spring link 6 will come into contact with the outside electrodes 3, 4 of the surge arrester 1, whereby the surge arrester 1 is protected from being damaged. It is disadvantageous that the spring force F cannot be selected too large, since otherwise, a plastic deformation of the melt element 13 will occur in the operating temperature range already, the deformation leading to an undesired shorting of the outside electrodes 3, 4. With the common spring forces F, the obtainable contact forces between the shorting link 6 and the outside electrodes 3, 4 are so small, however, that a surge current resistant shorting cannot be achieved.

Figure 3:
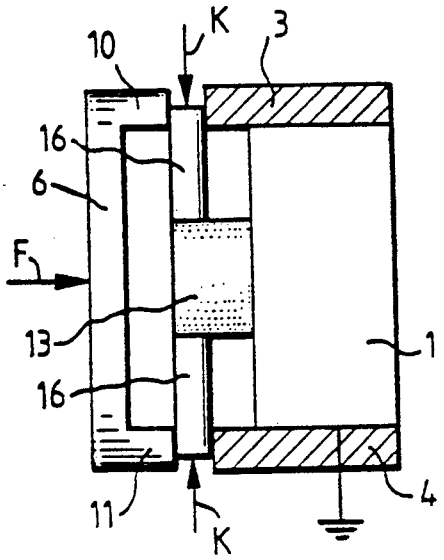
FIGS. 3 and 4 representations of the operating condition or the tripping condition, resp., of a two-pole surge arrester with a thermal protection device according to the invention.
Figure 4:
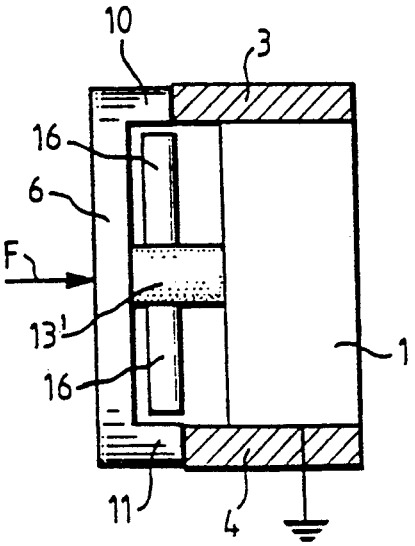
Figure 5:
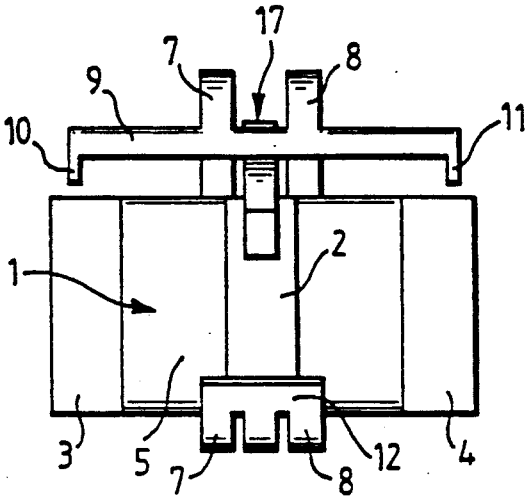
FIG. 5 is a front view of the thermal overload protection device according to the invention, arranged at a three-pole surge arrester, in the operating condition.
Figure 6:
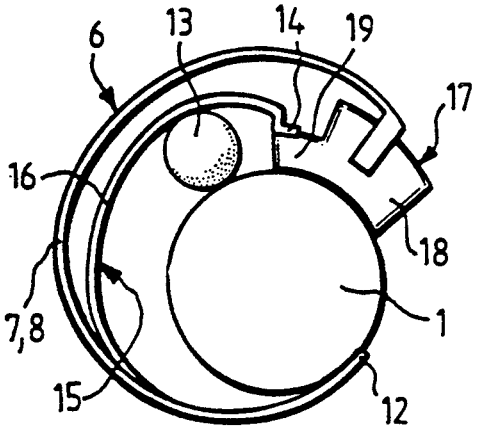
FIG. 6 is a side view of the thermal overload protection device according to the invention, arranged at a three-pole surge arrester, in the operating condition.
Figure 7:
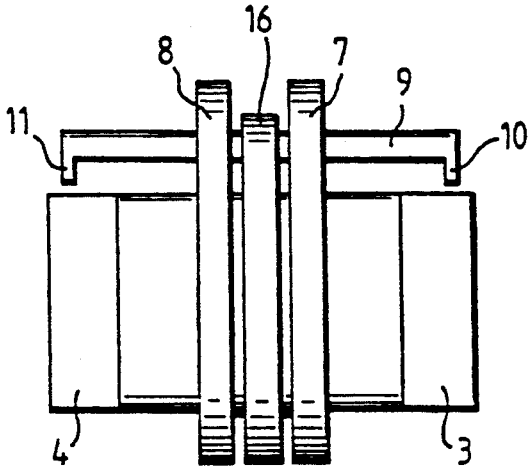
FIG. 7 is a rear view of the thermal overload protection device according to the invention, arranged at a three-pole surge arrester, in the operating condition.

In the thermal overload protection device for a two-pole surge arrester as the electronic component, according to the present invention as shown in FIGS. 3 and 4, the contact fingers 10, 11 of the shorting link 6 are held spaced and insulated relative to the outside electrodes 3, 4 by two tripping links 16. The tripping links 16 press, with the spring force K, against the melt element 13, which is simultaneously pressed against the surge arrester 1. When the melt element 13 fuses, under the action of a thermal overload, the spring force K will press the two tripping links 16 inwardly, so that the tripping condition shown in FIG. 4 is obtained, wherein the spring force F of the shorting link 6 is effective, not affected by the two tripping links 16. The two contact fingers 10, 11 contact the outside electrodes 3, 4 with full spring force F.

The embodiment of the thermal overload protection device shown in FIGS. 5 to 8 is employed for a gas-filled, three-pole, cylindrical surge arrester 1. It comprises a central electrode 2, which is connected to earth, not shown in detail, and two outside electrodes 3, 4. Between the central electrode 2 and each outside electrode 3, 4, there is a gas-filled carry-off chamber 5 with a spark gap.

Around the surge arrester 1, there is disposed a device 15 for tripping and a device 17 for actuating the shorting link 5 made from spring-elastic material. It is composed of two circularly bent spring brackets 7, 8, surrounding the surge arrester 1 over approximately 270°, and being disposed spaced and parallel to each other, a crosspiece 9 connecting the free ends of the spring brackets 7, 8, the crosspiece being arranged in the longitudinal direction of the cover surface of the surge arrester 1 and having one contact finger 10, 11 each at its ends, which are assigned to the outside electrodes 3, 4, and which are held spaced thereto. The shorting link 6 comprises, at the other end of its two spring brackets 7 and 8, a small foot plate 12 connecting the two spaced spring brackets 7, 8 to each other.

The tripping device 15 comprises the circularly bent spring-elastic tripping link 16, which is arranged between the two spring brackets 7, 8 of the shorting link 6, and which is connected with the small foot plate 12 of the shorting link 6. The tripping link 16 is made from spring material, in particular spring steel, integral with the shorting link 6. As is shown in particular in the side view according to FIG. 6, the foot plate 12 of the shorting link 6, and thus of the tripping link 16, is placed against the cover surface of the surge arrester 1 in an approximately five o'clock position. The tripping link 16 surrounds the surge arrester over approximately 220°, and holds a melt element 13 in the form of a solder pill, approximately at the eleven o'clock position, by pressing it against the periphery of the surge arrester 1. At the free end 14 of the tripping link 16, the device 17 for actuating the shorting link 6 is attached.

The device 17 for actuating the shorting link 6 comprises a locking element 18 corresponding approximately to the width of the tripping link 16. The locking element being clamped in between the crosspiece 9 of the shorting link 6 and the cover surface of the surge arrester 1, approximately at a 1:30 o'clock position. Locking element 18, being adapted, in the side view as a braking block, has at its rear end directed towards the melt element 13, and extension 19 having a smaller thickness and being connected with the tripping link 16.

The thermal overload protection device described above in FIGS. 5 through 8 operates as follows:

The tripping link 16 designed as the central spring presses against the melt element 13 in the form of a solder pill, and holds the locking element 18 fast. The locking element is located between the crosspiece 9 of the shorting link 6 and the periphery of the surge arrester 1. The shorting link 6 cannot, therefore, connect its contact fingers 10, 11 with the outside electrodes 3, 4. As soon as the melt element 13 fuses, when reaching a limit temperature which corresponds to an overload of the surge arrester 1, the locking element 18 is displaced tangentially, and the shorting link 6 presses the two contact fingers 10, 11 with its full spring force against the outside electrodes 3, 4. Thereby, the surge arrester 1 is protected by shorting.

Figure 8:
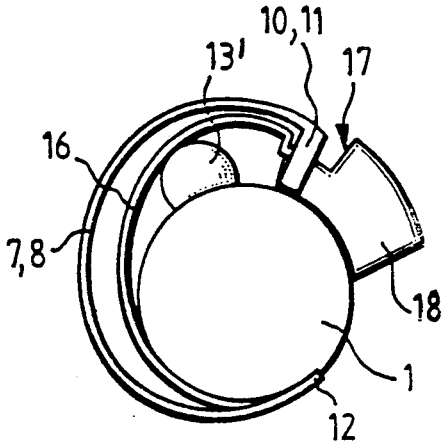
FIG. 8 is a side view corresponding to FIG. 6 with the thermal overload protection device, in the tripping condition.
Figure 9:
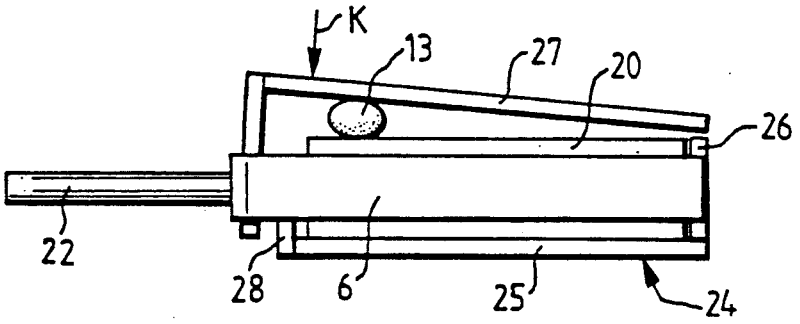
FIG. 9 is a side view of a semiconductor protection element with thermal overload protection device, in the operating condition.
Figure 10:
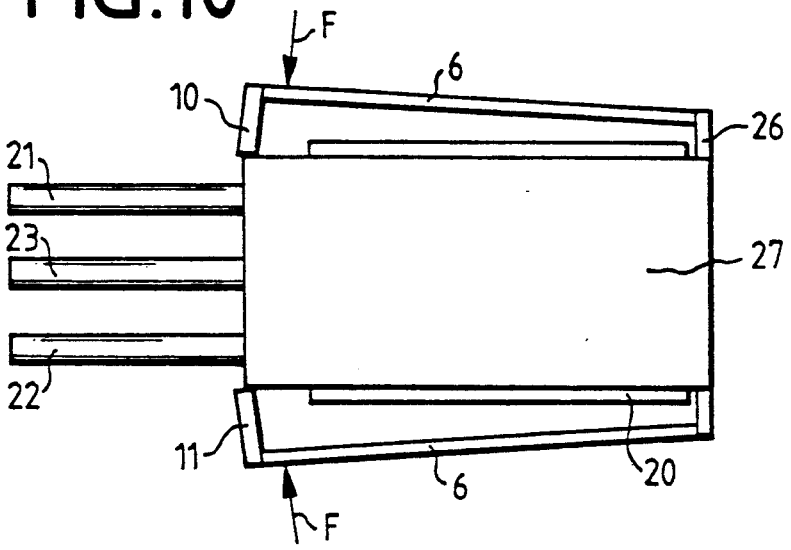
FIG. 10 is a top view of a semiconductor protection element with thermal overload protection device, in the operating condition.

The mode of operation of the tripping link 16 described above is based on the fact that it will radially approach the peripheral surface of the surge arrester 1, under the action of its spring force, when the melt element 13 fuses. The free end 14 being moved clockwise from the twelve o'clock position into the two o'clock position, as is shown in FIG. 8. The locking element 18 attached to the free end 14 of the tripping link 16 is moved tangentially, as is shown in FIG. 8, so that the locking element 18 will come out of engagement with the crosspiece 9, and the contact fingers 10, 11 of the shorting link 6 will now be capable to press with full spring force against the outside electrodes 3, 4 of the surge arrester 1. In FIG. 8, the melt element 13 is shown in the form of a solder pill in fused or molten condition.

In this case, a short between the earthed central electrode 2 and the outside electrodes 3, 4 will take place, so that the desired FAIL SAFE behavior in the form of a SERVO FAIL SAFE behavior is achieved.

The further embodiment of the thermal overload protection device shown in FIGS. 9 to 12 is employed for a semiconductor protection element 20; e.g., a thyristor or voltage limiter diode, which is provided with two terminal legs 21, 22 for the "a" and "b" lines of a telephone device, and with a central terminal leg 23 for the earth connection. Up to a certain tripping voltage, the thyristor or voltage limiter diode in component 20 will be insulating. Over this tripping voltage a current will flow. A voltage breakdown across component 20 to a residual voltage occurring for the thyristor diode, and a limiting voltage being obtained for the Zener or suppressor diode. In either case, a power consumption takes place, which might lead to an inadmissible heating of the component.

Figure 11:
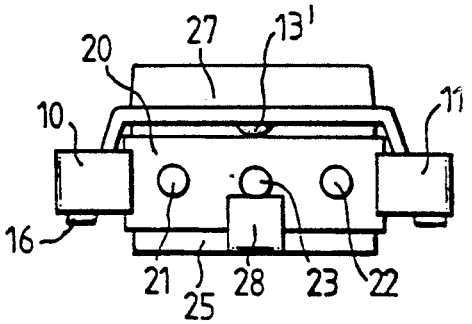
FIG. 11 is a front view of a semiconductor protection element with thermal overload protection device, in the operating condition.
Figure 12:
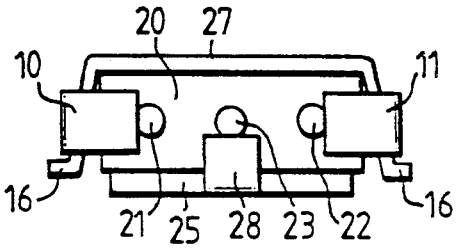
FIG. 12 is a front view of the thermal overload protection device, in the tripped condition.

In order to avoid this, the semiconductor protection element 20 is surrounded by a one-piece sheet-metal housing 24, composed of a bottom plate 25, a rear wall 26 and a cover plate 27. At the rear wall 26, the rear side ends of two lateral shorting links 6 are attached. At the free ends of the links 6, the contact fingers 10, 11 are positioned. The free end of the cover plate 27 is held, by means of the melt element 13, spaced from the component 20. Two tripping links 16 are provided on sides of the free end of the cover plate 27 for holding the contact fingers 10, 11 of the shorting links 6, in the operating condition. The shorting links being spaced to the terminal legs 21, 22 as is shown in FIG. 11. In the tripping condition according to FIG. 12, the tripping links 16 will come out of engagement with the contact fingers 10, 11 of the shorting link 6, so that the contact fingers 10, 11 can press, with full contact spring-force F, against the terminal legs 21, 22 and connect them to earth. For this purpose, the central terminal leg 23 is connected by means of an earthing lug 28, with the bottom plate 25 of the sheet-metal housing 24.

While specific embodiments of the invention have been shown and described in detail to illustrate the application of the principles of the invention, it will be understood that the invention may be embodied otherwise without departing from such principles.

I claim:

1. A thermal overload protection device for an electronic component, the device comprising:

a melt element in thermal contact with the electronic component, said melt element changing shape when the electronic component reaches a thermal overload temperature;

tripping means positioned in contact with said melt element and for responding to said melt element changing shape, said tripping means being in an operating condition when said melt element is below said thermal overload temperature and said tripping means being in a tripped condition when said melt element is above said thermal overload temperature; and shorting means including a shorting link moveable into contact with an electrode of the electronic component and for creating a surge resistant contact force on said shorting link to cause said shorting link to be applied to said electrode and diverting electricity away from the component, said shorting means moving said shorting link into contact with the electrode by said surge resistant contact force when said tripping means is in said tripped condition, said shorting means having a force mechanism separate from said tripping means.

2. A device in accordance with claim 1, wherein:

said tripping means has a tripping link biased against said melt element, said tripping means also has a locking element holding said shorting link spaced from said electrode, said tripping link is connected to said locking element and said tripping link acts on said locking element to release said shorting link.

3. A device in accordance with claim 2, wherein:

said shorting link has a contact finger electrically connectable with said electrode and said shorting link is biased against said locking element; and said tripping link, connected to said locking element, moves said locking element when said melt element changes shape, said locking element moving to release said shorting link when said tripping means is in said tripped condition.

4. A device in accordance with claim 2, wherein:

the electronic component has a central electrode and two outside electrodes;

said shorting link has two contact fingers electrically connectable with said two outside electrodes and extending in a longitudinal direction of the electronic component; and two spring brackets surrounding the electronic component over approximately 270 degrees, one of said two spring brackets positioned on one side of said tripping link, and another of said two spring brackets positioned on another side of said tripping link, said two spring brackets connected to said shorting link and biasing said shorting link toward said two outside electrodes, said locking element holding said two contact fingers electrically insulated from said two outside electrodes.

5. A device in accordance with claim 4, wherein;

said two spring brackets and said tripping link are formed from a single integral material and ends of said two spring brackets and an end of said tripping link are connected with a common small foot plate.

6. A device in accordance with claim 1, wherein:

the component is surrounded by a sheet metal housing, said sheet metal housing having a cover plate and a side wall, said cover plate being biased against said melt element as part of said tripping means, said cover plate also having a side acting as a tripping link, said side wall acting as a shorting link.

7. A device in accordance with claim 1, wherein:

said tripping means has a tripping link biased against said melt element with a tripping force less than said surge resistant contact force.

8. A device in accordance with claim 1, further comprising:

locking means for insulating said shorting link from said electrode when said tripping means is in said operating condition, and said locking means connecting said shorting link to said electrode when said tripping means is in said tripped condition.

9. A device in accordance with claim 8, wherein:

said locking means has a locking element in an insulated position when said tripping means is in said operating condition, and said tripping means moves said locking element into a tripped position in said tripped condition, said tripped condition of said locking element bringing said shorting link into electrical contact with said electrode by said surge resistant contact force.

10. A device in accordance with claim 1, wherein:

the electronic component is a surge arrester and removes surges from a first and second electrode to a third electrode;

said shorting link being connected to said third electrode on one end and biased against said first and second electrodes on another end by said surge resistant contact force; and said tripping means cocking said shorting link away and insulated from said first and second electrodes, said tripping means biased against said melt element with a tripping force just large enough to reliably release said shorting link when said melt element changes shape.

11. A thermal overload protection device for an electronic component, the device comprising:

a melt element in the thermal contact with the electronic component, said melt element changing shape when the electronic component reaches a thermal overload temperature;

tripping means for responding to said melt element changing shape, said tripping means including a tripping link biased against said melt element, said tripping means being in an operating condition when said melt element is below said thermal overload temperature and said tripping means being in a tripped condition when said melt element is above said thermal overload temperature, said tripping means also includes a locking element positioned against an electrode of the electronic component, said tripping link being connected to said locking element and said tripping link moving said locking element away from the electrode when said melt element reaches the thermal overload temperature; and shorting means including a shorting link and for creating a surge resistant contact force on said shorting link against said locking element, said shorting means moving said shorting link by said surge resistant contact force into contact with the electrode when said tripping means is in said tripped condition and said shorting link is moved away from the electrode, said contact of the electrode with said shorting link diverting electricity away from the electrical component, said shorting means having a shorting mechanism separate from said tripping means.

* * * * *